US006685021B2

(12) United States Patent
Dodson et al.

(10) Patent No.: US 6,685,021 B2
(45) Date of Patent: Feb. 3, 2004

(54) ARTICLE-PACKAGING STRUCTURE

(75) Inventors: Gordon Charles Dodson, Lewis Center, OH (US); Kyozaburo Takagi, Centerville, OH (US)

(73) Assignee: Fukuvi USA, Inc., Huber, OH (US)

( * ) Notice: Subject to any disclaimer, the term of this patent is extended or adjusted under 35 U.S.C. 154(b) by 82 days.

(21) Appl. No.: 10/140,315

(22) Filed: May 6, 2002

(65) Prior Publication Data

US 2003/0205494 A1 Nov. 6, 2003

(51) Int. Cl.[7] ..... B65D 85/20
(52) U.S. Cl. ..... 206/443; 206/586; 206/391
(58) Field of Search ..... 206/391, 443, 206/453, 586, 587, 594, 597, 599; 108/55.5

(56) References Cited

U.S. PATENT DOCUMENTS 2,798,600 A * 7/1957 O'Konski
3,097,741 A * 7/1963 Schwartz
3,104,085 A * 9/1963 Skladany
3,935,357 A * 1/1976 Padovani
4,317,517 A * 3/1982 Tisdale
5,060,801 A * 10/1991 Vilas-Boas

FOREIGN PATENT DOCUMENTS

EP 0 574 970 A2 * 12/1993

OTHER PUBLICATIONS http://www.ltv–copperweld.com/pdfs/MechPocket.pdf, Mechanical Steel Tubing, LTV Copperweld, Sep. 3, 2002, p. 4–5.

* cited by examiner

*Primary Examiner*—David T. Fidei
(74) *Attorney, Agent, or Firm*—Dinsmore & Shohl LLP

(57) ABSTRACT

Extruded article-packaging members are arranged to form a frame and are bound about a set of elongate articles like tubes, rods, poles, beams, etc. In accordance with one embodiment of the present invention, an article-packaging member is provided defining an extruded cross section. The extruded cross section extends along substantially an entire length of the packaging member and comprises a structural framework, a bundling channel, and at least one set of pliable projections. The structural framework is formed of a relatively rigid extruded plastic material. The bundling channel is formed in the extruded cross section along an exterior face of the article-packaging member. The pliable projections are formed of a relatively pliable plastic material extending from the structural framework.

11 Claims, 6 Drawing Sheets

ARTICLE-PACKAGING STRUCTURE

BACKGROUND OF THE INVENTION

The present invention relates to the packaging of articles for shipment and storage and, more specifically, to the bundling and packaging of elongate tubing products.

Tubing products and other elongate structures are often shipped in bundles because their size and shape makes them difficult to ship and store individually. Commonly, a combination of stock lumber and metal bands are used to arrange and secure a number of individual articles in a single bundle. The lumber is utilized to enable stacking and movement of the bundles and the metal bands are used to secure the products in the bundle. Unfortunately, irregularities in the lumber used for packaging can make it unreliable and difficult to work with. Indeed, it is typically necessary to discard a significant amount of lumber because it is unfit for bundling the product. According to one finding of the present invention, it has been noted by the present inventors that lumber products carry dirt, oils, and surface irregularities that often degrade and damage the articles to be bundled. Accordingly, there is a need for an improved scheme for bundling, storing and shipping articles, particularly elongate articles like tubes, rods, poles, beams, etc.

BRIEF SUMMARY OF THE INVENTION

This need is met by the present invention wherein extruded article-packaging members are arranged to form a frame and are bound about a set of elongate articles like tubes, rods, poles, beams, etc. In accordance with one embodiment of the present invention, an article-packaging member is provided defining an extruded cross section. The extruded cross section extends along substantially an entire length of the packaging member and comprises a structural framework, a bundling channel, and at least one set of pliable projections. The structural framework is formed of a relatively rigid extruded plastic material. The bundling channel is formed in the extruded cross section along an exterior face of the article-packaging member. The pliable projections are formed of a relatively pliable plastic material extending from the structural framework.

In accordance with another embodiment of the present invention, an article-packaging member is provided defining an extruded cross section. The extruded cross section comprises the structural framework and a set of partial cross-cuts. The partial cross-cuts define sides of a packaging member quadrilateral and extend a sufficient distance through the extruded cross section to create a pivoting connection between selected sides of the packaging member quadrilateral.

In accordance with yet another embodiment of the present invention, a packaged bundle of articles is provided comprising a plurality of articles, a pair of transverse frames, and a bundling band secured about each of the transverse frames. The articles are arranged along substantially parallel longitudinal axes in a stack defining a height h, width w, and length l. The pair of transverse frames are spaced along the length l and bound the plurality of articles. Each of the frames defines a quadrilateral having dimensions corresponding to the height h and the width w. At least a portion of the quadrilateral is defined by an article-packaging member. A bundling channel is formed in the extruded cross section along an exterior face of the article-packaging member and a bundling band is secured about each of the transverse frames within the bundling channel.

Accordingly, it is an object of the present invention to provide an improved article-packaging scheme utilizing plastic article-packaging members. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
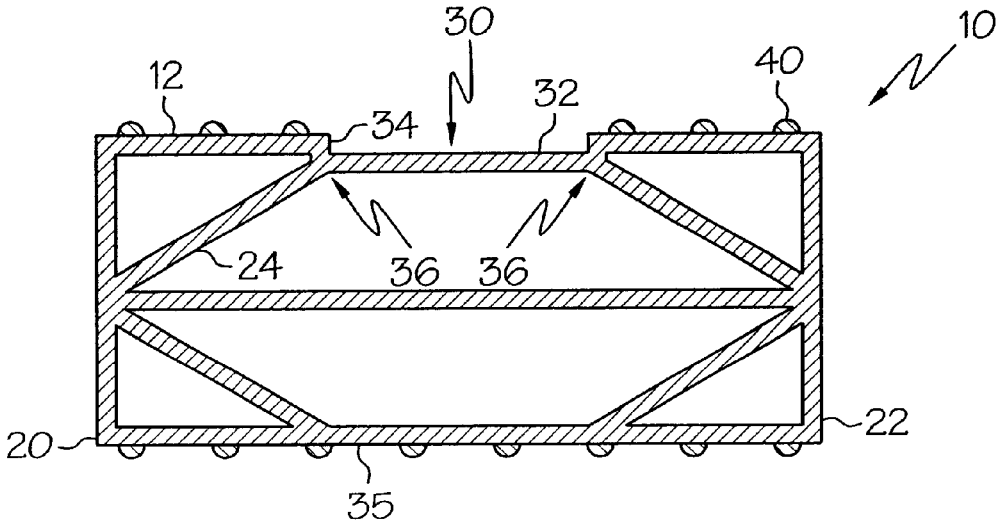
FIG. 1 is a cross-sectional illustration of an article-packaging member according to one embodiment of the present invention.

Referring collectively to FIGS. 1–5, article-packaging members 10 according to the present invention are illustrated in detail. Each article-packaging member 10 is preferably manufactured in an extrusion process and, as such, defines an extruded cross section extending along its entire length. The article-packaging members may be formed from any plastic material but are preferably formed from extrudable plastic materials because the design of the present invention is well-suited for manufacture by an extrusion process. Preferred materials include polyvinyl chloride (PVC), low or high-density polyethylene or polypropylene, acrylics, polycarbonates, and thermoplastic elastomers. As will be appreciated by those familiar with the art of extrusion, an extruded member defines a substantially uniform extruded cross section that extends along the entire length of the member.

The article-packaging member 10 comprises a structural framework 20, a bundling channel 30, and a plurality of pliable projections 40. The structural framework 20 is formed of a relatively rigid extruded plastic material. The bundling channel 30 is formed in the extruded cross section along an exterior face 12 of the article-packaging member 10. The pliable projections 40 are formed of a relatively pliable plastic material and extend from the structural framework 20. As will be appreciated by those familiar with the art of extrusion, because the article-packaging member 10 includes relatively rigid and relatively pliant materials, it may be fabricated by generating a co-extrusion defining a cross section including relatively rigid portions and relatively pliable or soft portions. The relatively pliable portions may be extruded using softer plastics like soft, flexible thermoplastic elastomers.

It is contemplated that the structural framework 20 and the projections 40 may be formed of a common material. In which case, the structural framework 20 and projections 40 would not have relatively different rigidity or pliability.

The structural framework 20 comprises an external support framework 22 and an internal support framework 24, both formed of a rigid extruded plastic material. The structural framework 20 defines a continuous cross section including the external support framework 22 and the internal support framework 24. The set of pliable projections 40 extend from the external support framework 22 and define a support plane displaced from the remainder of the structural framework.

The bundling channel 30 is open to an exterior of the article-packaging member 10 and defines a substantially planar recessed surface 32 partially bounded by sidewalls 34. The sidewalls 34 of the bundling channel 30 are preferably substantially perpendicular to the recessed surface of the bundling channel to permit proper alignment of a bundling strap (described below) in the bundling channel 30. The recessed surface 32 is preferably supported by the internal support framework 24 because bundling straps aligned in the bundling channel 30 are typically placed under significant tension. In the embodiments illustrated in FIGS. 1 and 2, opposite sides or cross-sectional extremities 36 of the recessed surface 32 are supported by the internal support framework 24. The planar recessed surface 32 extends along the entire length of the bundling channel 30 and is generally parallel to an opposing exterior face 35 of the structural framework 20. Typically, the recessed surface 32 is at least 25% as wide as the packaging member 10 and is unbounded at opposite ends of the bundling channel 30 so that a bundling band may extend through the opposite ends of the bundling channel 30 in contact with the recessed surface 32.

Figure 2:
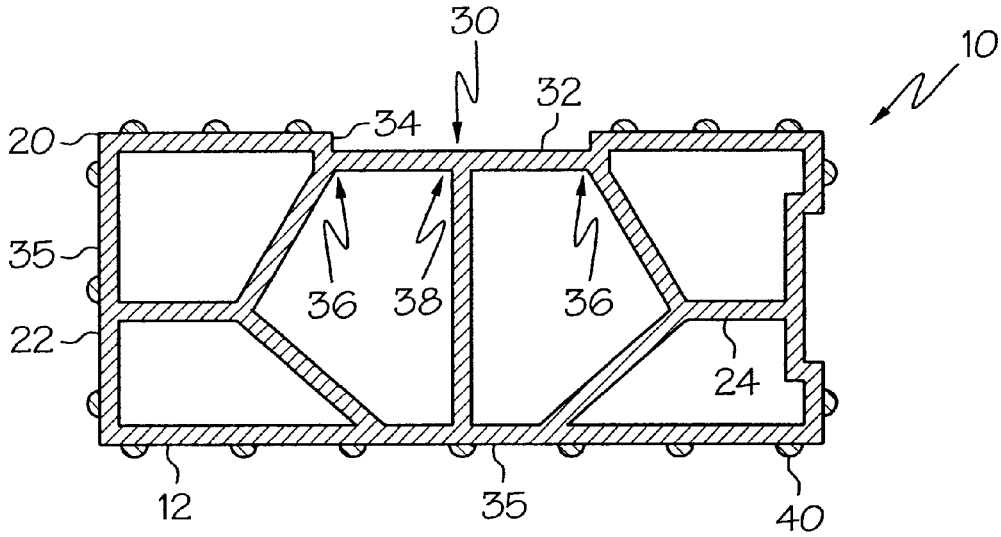
FIGS. 2–4 are a cross-sectional illustrations of article-packaging members according to additional embodiments of the present invention.
Figure 3:
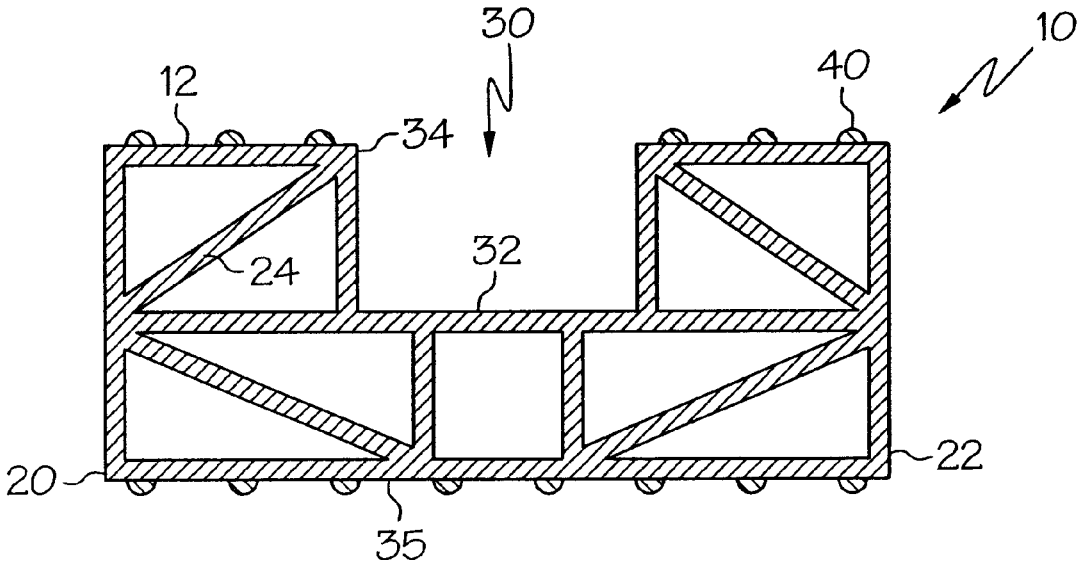
Figure 4:
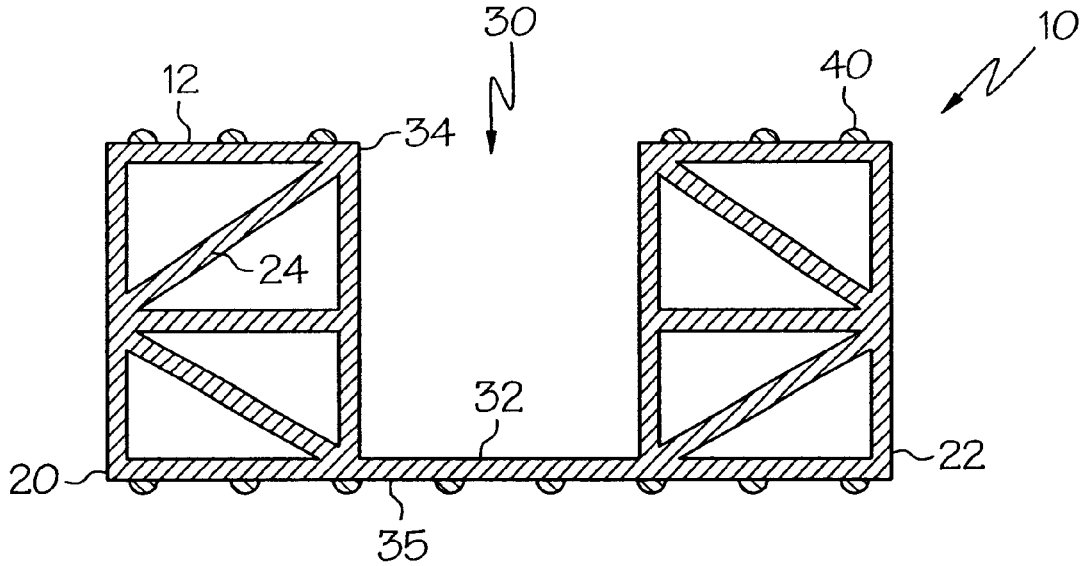

In the embodiment illustrated in FIG. 2, a pair of bundling channels 30 are formed in the extruded cross section along an alternate exterior faces of the article-packaging member 10. In this manner, either one of two sides of the packaging member can be positioned to receive a bundling band. In addition, in the FIG. 2 embodiment, a midpoint 38 of the recessed surface 32 is supported by the internal support framework 24. It is contemplated that, in addition to the internal support frameworks 24 illustrated in FIGS. 1 and 2, a variety of internal support framework configurations may be utilized with the present invention. FIGS. 3 and 4 illustrate alternative embodiments of the present invention where the depth of the bundling channel 30 is increased. It is contemplated that, in the embodiment of FIG. 4, where the bundling channel 30 extends from the exterior face 12 to the portion of the external support framework defining the opposing exterior face 35, the thickness of that portion of the framework defining the opposing exterior face may be increased, relative to the remaining portions of the framework.

Figure 5:
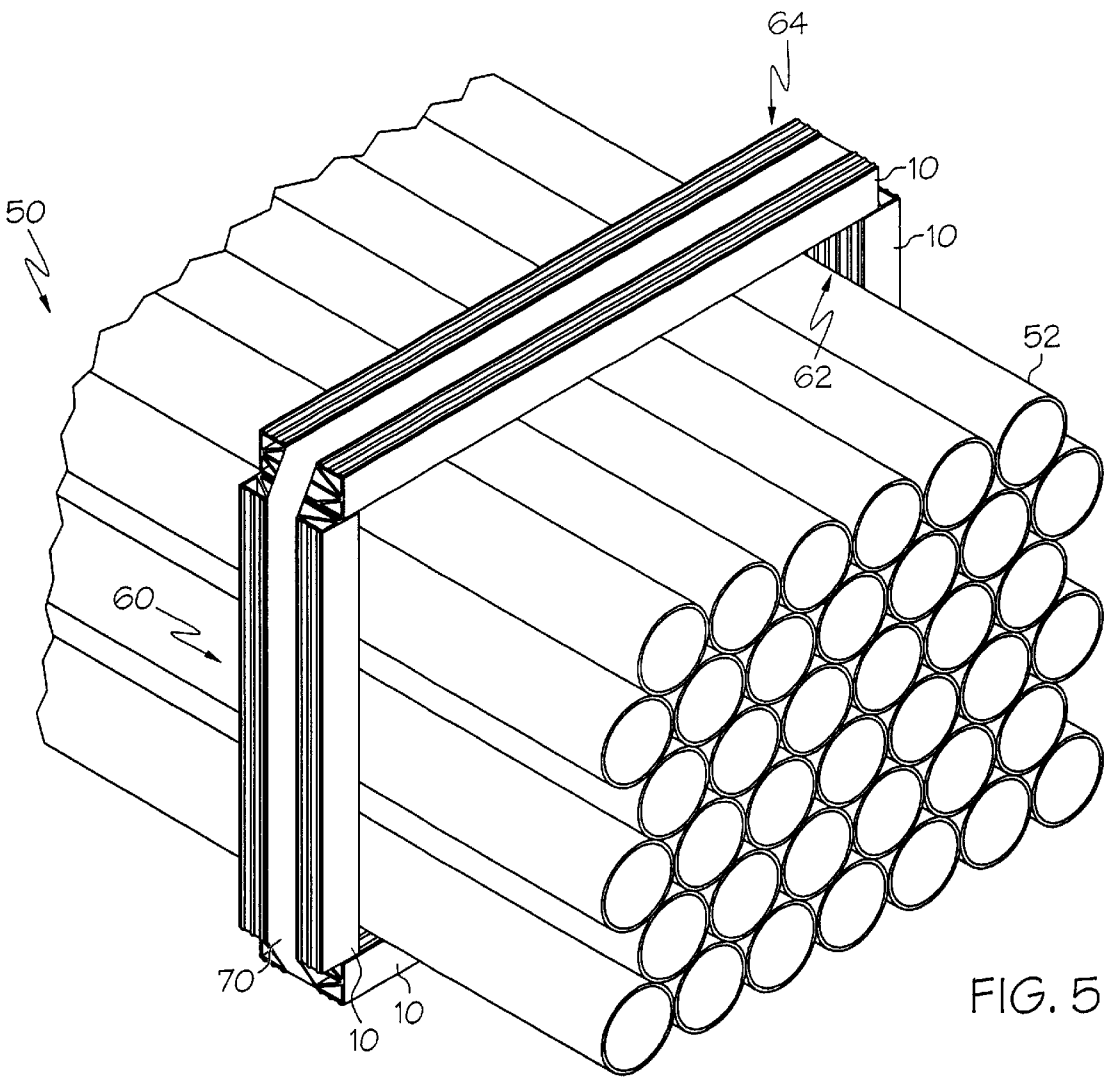
FIG. 5 is a three-dimensional illustration of a packaged bundle of articles according to the present invention.

Referring now to FIG. 5, a packaged bundle 50 of articles 52 is illustrated. In the illustrated embodiment, the articles 52 comprise generally tubular members and are arranged along substantially parallel longitudinal axes in a stack defining a height h, width w, and length l. A pair of transverse frames 60, only one of which is illustrated in FIG. 5, are spaced along the length l of the packaged bundle 50. Each of the frames 60 is formed by four article-packaging members 10 arranged to define a quadrilateral. The dimensions of the quadrilateral correspond to the height h and the width w of the bundle 50. A bundling band 70 is secured about each of the transverse frames 60 and is positioned within the bundling channel 30 formed in the external support framework 22 along the exterior of each frame 60. The bundling band 70 may be a metal, plastic, or fiber reinforced strap, is placed under tension, and forms a complete loop about each transverse frame 60.

As described above each of the article-packaging members 10 include sets of pliable projections 40 that collectively form an interior anti-skid surface against which the bundled articles 52 rest and an exterior anti-skid surface used for secure stacking of respective bundles of articles. Specifically, to aid in securing the articles 52 within the transverse frames 60, a number of sets of pliable projections 40 defines an interior contact plane along respective interiors 62 of the transverse frames 60. The interior contact planes of each transverse frame 60 intersect to form an interior contact quadrilateral having dimensions corresponding to the height h and the width w of the bundle 50 of articles 52. Peripheral portions of the outermost bound articles 52 are urged against the interior contact plane and, as such, are engaged frictionally with the respective interiors 62 of the frames 60.

Figure 6:
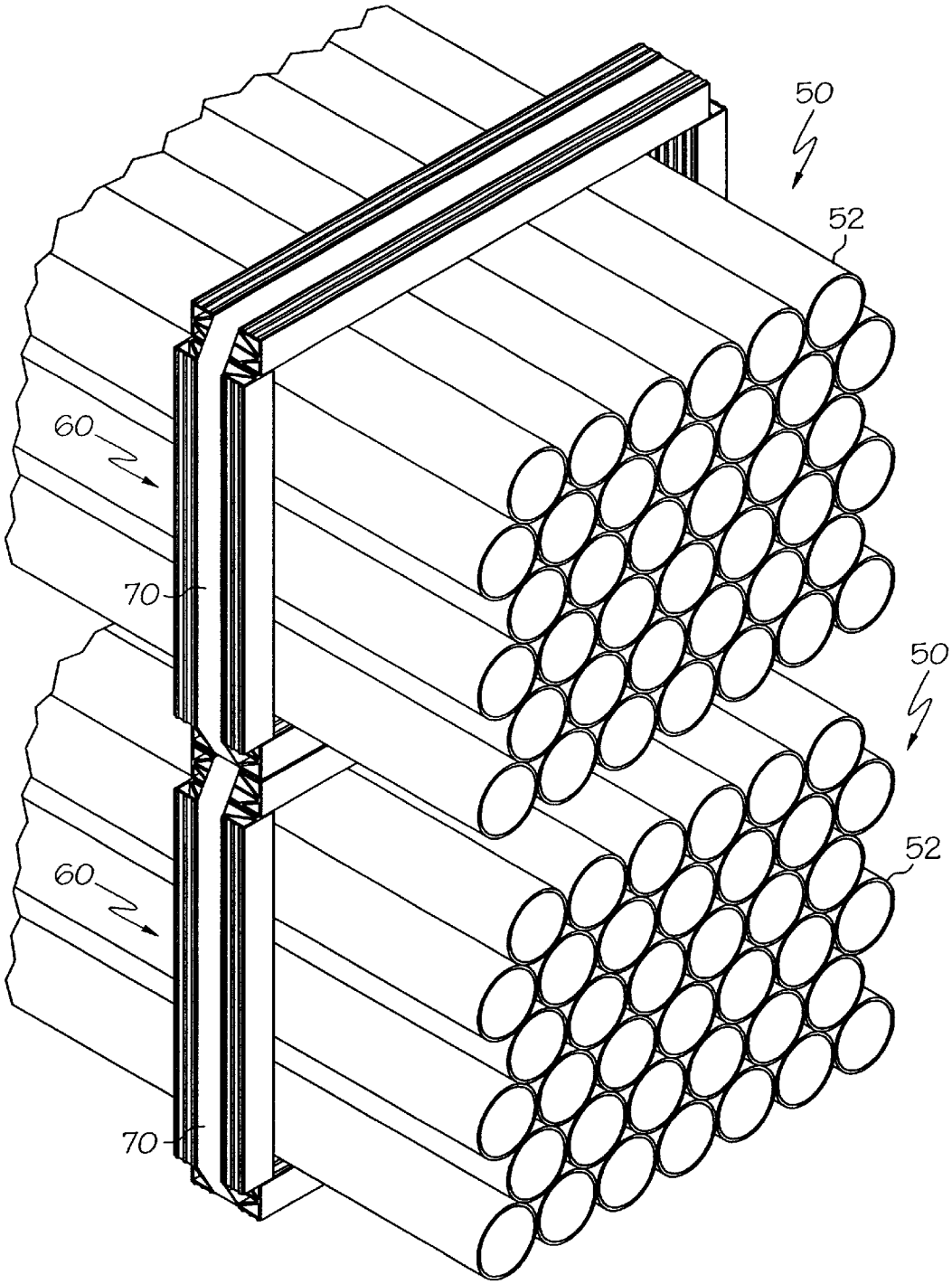
FIG. 6 is a three-dimensional illustration of a stack of packaged bundles of articles according to the present invention.

Additional sets of pliable projections 40 define an exterior contact plane along respective exteriors 64 of the transverse frames 60. The exterior contact planes of each frame 60 intersect to form an exterior contact quadrilateral having dimensions greater than the height h and the width w of the bundle 50 of articles 52. As is illustrated in FIG. 6, respective bundles 50 may be stacked upon one another, in which case, the pliable projections 40 defining the exterior contact planes provide a high friction contact surface between the bottom bundle 50 and the surface upon which it is stacked and between the bundles 50 themselves.

Accordingly, the article packaging members 10 of the present invention are particularly advantageous in that they provide for secure and reliable article storage. There is limited need for secondary materials to help secure the bundles or the articles within the bundles. Indeed, many tubular or longitudinal articles cause damage or are easily damaged if they are not secured properly. In addition, the consistently true dimensions and longitudinally straight profiles of the members 10 represent vast improvements in storage and handling over wooden or wood composite packaging members. The packaging members 10 of the present invention are also less prone to mar, scratch, or otherwise damage articles because the profile of the plastic extrusion is much more smooth and uniform than typical lumber products. Finally, it is noted that the weight of the article packaging members 10 of the present invention is significantly reduced by forming it as a member including a substantially hollow structural framework. As will be appreciated by those practicing the present invention, relatively lightweight packaging members are preferred over heavier ones in most applications.

Figure 7:
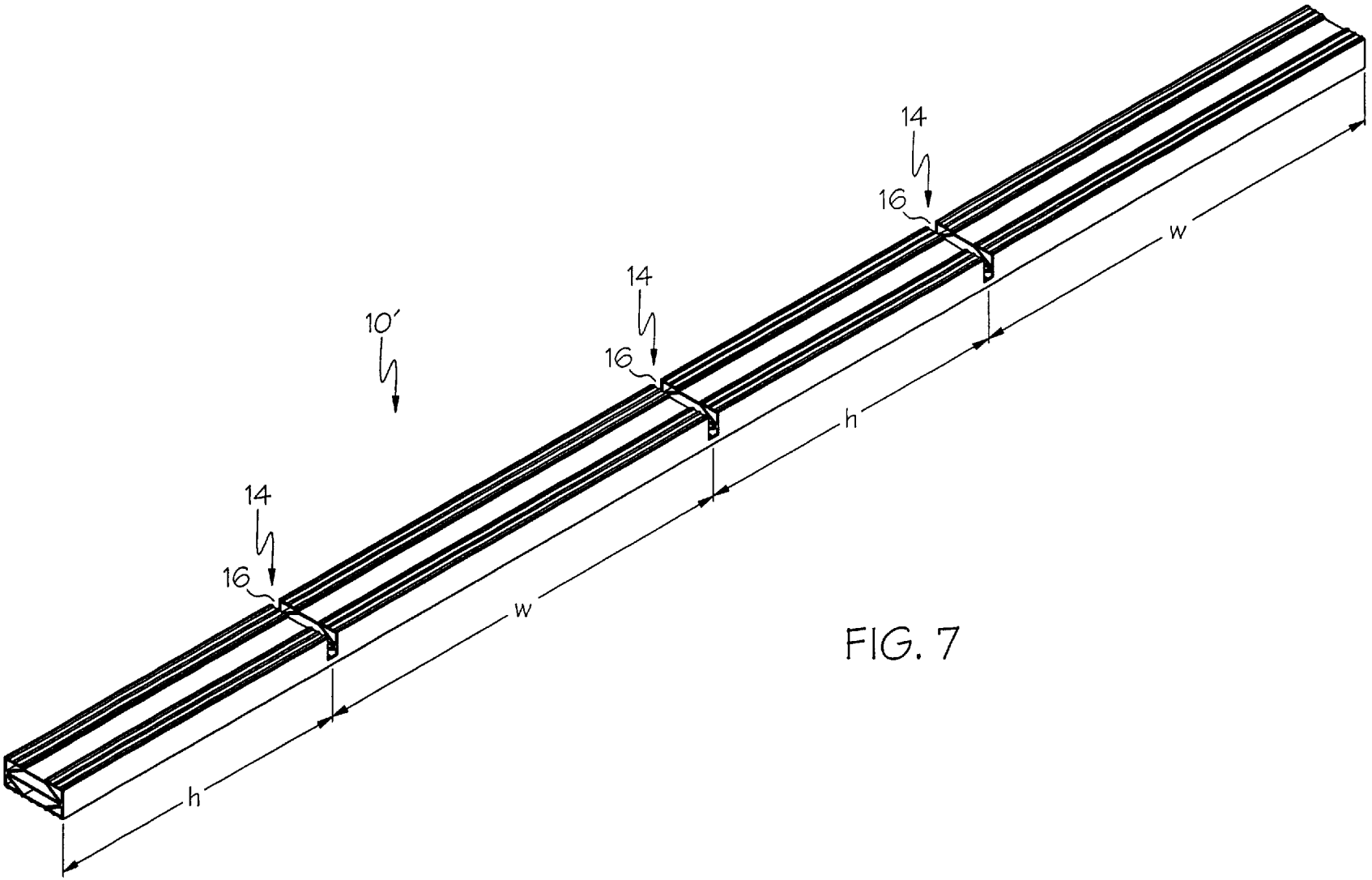
FIGS. 7 and 8 are three-dimensional illustrations of article-packaging members according to alternative embodiments of the present invention.
Figure 8:
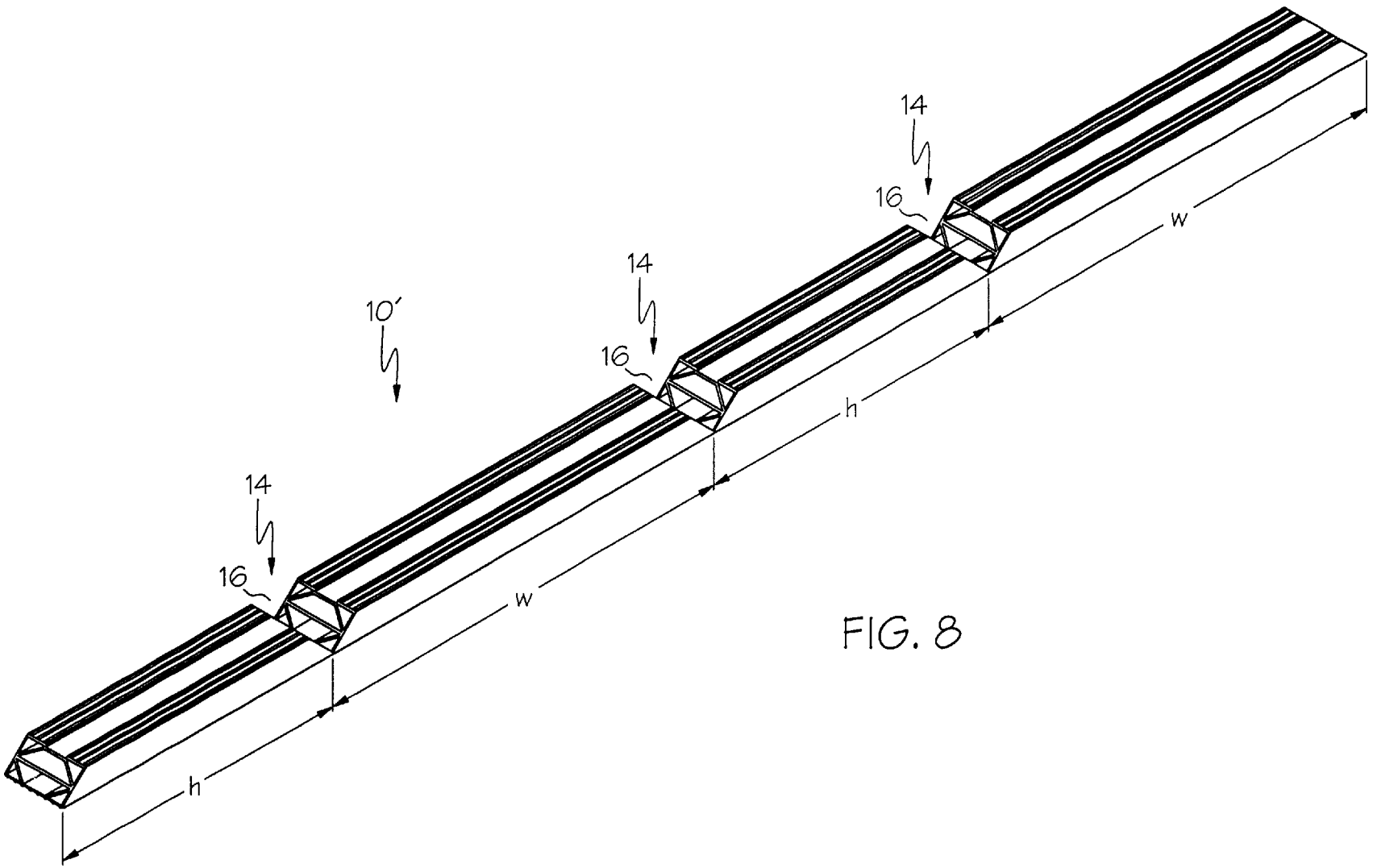

In the embodiments of the present invention illustrated in FIGS. 7 and 8, the articleti-packaging members 10 defining the quadrilaterals comprise disjointed packaging members. However, referring to FIGS. 7 and 8, it is contemplated that the article-packaging member quadrilaterals may be presented as a single, unitary, continuous packaging member or extrusion 10' including joints 14 defined by a set of partial cross-cuts 16. The partial cross-cuts 16 may be straight cuts, as is illustrated in FIG. 7, or 90 degree V-shaped notches, as is illustrated in FIG. 8. In either case, the cross-cuts 16 extend a sufficient distance through the extruded cross section to create a pivoting connection between selected sides of the quadrilateral. Specifically, the partial cross-cuts 16 extend from a top surface of the packaging member 10' to, but not through, a bottom side of the packaging member 10'. As such, each of the joints may be used to define individual sides or segments of a substantially orthogonal quadrilateral defining the height h and width w dimensions of the sides of the quadrilateral.

In the case of the straight cross-cuts 16 illustrated in FIG. 7, the packaging member 10' is bent or folded so as to open the cross-cuts 16 and form the corners and sides of the quadrilateral. In the case of the V-shaped cross-cuts illustrated in FIG. 8, the packaging member 10' is bent or folded so as to close the sides of the V-shaped cross-cuts against each other to form the corners and sides of the quadrilateral. It is noted that the width of each cross-cut illustrated in FIG. 7 is exaggerated for illustrative purposes.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue. It is also noted that reference herein to pliable and rigid structures or members is made in an effort to characterize the differences in rigidity of two structures and, as such, is presented merely as a comparison of two structures in a relative sense.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A packaged bundle of articles comprising:

a plurality of articles arranged along substantially parallel longitudinal axes in a stack defining a height h, width w, and length l;

a pair of transverse frames spaced along said length l and bounding said plurality of articles, each of said frames defining a quadrilateral having dimensions corresponding to said height h and said width w, wherein at least a portion of said quadrilateral is defined by an article-packaging member defining an extruded cross section, said extruded cross section extending along substantially an entire length of said packaging member and comprising:

a structural framework formed of a relatively rigid extruded plastic material, a bundling channel formed in said extruded cross section along an exterior face of said article-packaging member; and a bundling band secured about each of said transverse frames and positioned within said bundling channel formed in said external support framework along respective exteriors of said transverse frames.

2. A packaged bundle of articles as claimed in claim 1 wherein said extruded cross section comprises at least two sets of pliable projections, a first of which defines an interior contact plane along respective interiors of said transverse frames, and a second of which defines an exterior contact plane along respective exteriors of said transverse frames.

3. A packaged bundle of articles as claimed in claim 2 wherein peripheral portions of select ones of said bound articles lie in said interior contact plane.

4. A packaged bundle of articles as claimed in claim 1 wherein said bundling band forms a complete loop about said transverse frame.

5. A packaged bundle of articles as claimed in claim 1 further comprising at least one set of pliable projections formed of a relatively pliable plastic material extending from said structural framework.

6. A packaged bundle of articles as claimed in claim 1 wherein:

all four segments of said quadrilateral are defined by article-packaging members defining said extruded cross section; and said extruded cross section comprises at least two sets of pliable projections, a first of which defines an interior contact plane along respective interiors of said transverse frames, and a second of which defines an exterior contact plane along respective exteriors of said transverse frames.

7. A packaged bundle of articles as claimed in claim 6 wherein:

said article-packaging members defining said quadrilateral are formed as segments of a single unitary extrusion;

said segments are defined by respective cuts through a portion of said extruded cross section; and said respective cuts are configured to permit arrangement of said segments in a substantially orthogonal quadrilateral.

8. A packaged bundle of articles as claimed in claim 6 wherein:

said pliable projections of each of said article-packaging members define an interior contact plane along respective interiors of said transverse frames;

respective interior contact planes intersect to form an interior contact quadrilateral associated with each transverse frame and having dimensions corresponding to said height h and said width w of said bundle of articles.

9. A packaged bundle of articles as claimed in claim 8 wherein:

said pliable projections of each of said article-packaging members further define an exterior contact plane along respective exteriors of said transverse frames;

respective exterior contact planes intersect to form an exterior contact quadrilateral associated with each transverse frame and having dimensions greater than said height h and said width w of said bundle of articles.

10. A packaged bundle of articles as claimed in claim 6 wherein said article-packaging members defining said quadrilateral comprise disjointed packaging members.

11. A packaged bundle of articles as claimed in claim 1 wherein said quadrilateral is defined by a single article-packaging member including joints defined by a set of partial cross-cuts defining sides of said quadrilateral, wherein said partial cross-cuts extend a sufficient distance through said extruded cross section to create a pivoting connection between selected sides of said quadrilateral.

* * * * *